US007613612B2

(12) United States Patent
Kemmochi et al.

(10) Patent No.: US 7,613,612 B2
(45) Date of Patent: Nov. 3, 2009

(54) VOICE SYNTHESIZER OF MULTI SOUNDS

(75) Inventors: Hideki Kemmochi, Shizuoka (JP); Jordi Bonada, Barcelona (ES)

(73) Assignee: Yamaha Corporation, Hamamatsu-Shi (JP)

( * ) Notice: Subject to any disclaimer, the term of this patent is extended or adjusted under 35 U.S.C. 154(b) by 695 days.

(21) Appl. No.: 11/345,023

(22) Filed: Jan. 31, 2006

(65) Prior Publication Data

US 2006/0173676 A1 Aug. 3, 2006

(30) Foreign Application Priority Data

Feb. 2, 2005 (JP) ..... 2005-026855

(51) Int. Cl.
*G10L 13/04* (2006.01)

(52) U.S. Cl. ..... 704/264; 704/258; 704/266; 704/268; 704/205; 84/610; 84/627; 84/661

(58) Field of Classification Search ..... 704/205, 704/207, 219, 220, 222, 209, 208, 258, 264, 704/268, 266, 224; 84/610, 627, 661
See application file for complete search history.

(56) References Cited

U.S. PATENT DOCUMENTS

| | | | | | |
|---|---|---|---|---|---|
| 4,783,805 | A | * | 11/1988 | Nishio et al. | 704/207 |
| 5,210,366 | A | * | 5/1993 | Sykes, Jr. | 84/616 |
| 5,642,470 | A | | 6/1997 | Yamamoto et al. | |
| 5,704,007 | A | * | 12/1997 | Cecys | 704/260 |
| 5,750,912 | A | * | 5/1998 | Matsumoto | 84/609 |
| 5,870,704 | A | * | 2/1999 | Laroche | 704/209 |
| 5,930,755 | A | * | 7/1999 | Cecys | 704/260 |
| 6,003,000 | A | * | 12/1999 | Ozzimo et al. | 704/219 |
| 6,029,133 | A | * | 2/2000 | Wei | 704/265 |
| 6,073,100 | A | * | 6/2000 | Goodridge, Jr. | 704/258 |
| 6,111,181 | A | * | 8/2000 | Macon et al. | 84/603 |
| 6,125,346 | A | * | 9/2000 | Nishimura et al. | 704/258 |
| 6,424,939 | B1 | * | 7/2002 | Herre et al. | 704/219 |
| 6,992,245 | B2 | * | 1/2006 | Kenmochi et al. | 84/622 |
| 7,016,841 | B2 | * | 3/2006 | Kenmochi et al. | 704/258 |
| 7,085,712 | B2 | * | 8/2006 | Manjunath | 704/219 |
| 7,379,873 | B2 | * | 5/2008 | Kemmochi | 704/269 |

FOREIGN PATENT DOCUMENTS

JP 07-146695 6/1995

(Continued)

OTHER PUBLICATIONS

Bonada, Jordi; Spectral Approach to the Modeling of the Singing Vice, Audio Engineering Society Convention Paper, New York, NY, USA, Sep. 21-24, 2004, pp. 1-10.

(Continued)

*Primary Examiner*—Vijay B Chawan
(74) *Attorney, Agent, or Firm*—Morrison & Foerster LLP

(57) ABSTRACT

In a voice synthesizer, an envelope acquisition portion obtains a spectral envelope of a reference frequency spectrum of a given voice. A spectrum acquisition portion obtains a collective frequency spectrum of a plurality of voices which are generated in parallel to one another. An envelope adjustment portion adjusts a spectral envelope of the collective frequency spectrum obtained by the spectrum acquisition portion so as to approximately match with the spectral envelope of the reference frequency spectrum obtained by the envelope acquisition portion. A voice generation portion generates an output voice signal from the collective frequency spectrum having the spectral envelope adjusted by the envelope adjustment portion.

7 Claims, 11 Drawing Sheets

FOREIGN PATENT DOCUMENTS

| | | |
|---|---|---|
| JP | 10-078776 | 3/1998 |
| JP | 2004-077608 | 3/2004 |

OTHER PUBLICATIONS

Kahlin, Daniel; The Chorus Effect Revisited—Experiments in Frequency-Domain Analysis and Simulation of Ensemble Sounds, Euromicro Conference, 25th Milan, Italy, Sep. 8-10, 1999, Los Alamitos, CA, USA, IEEE Computer Society, US, vol. 2, pp. 75-80.

Bonada, Jordi; Voice Solo to Unison Choir Transformation, Audio Engineering Society Convention Paper 6362, New York NY, US, vol. 118, May 31, 2005, pp. 1-4.

* cited by examiner

VOICE SYNTHESIZER OF MULTI SOUNDS

BACKGROUND OF THE INVENTION

1. Technical Field

The present invention relates to a technology of synthesizing voices with various characteristics.

2. Related Art

Conventionally, there have been proposed technologies to apply various effects to voices. For example, Japanese Non-examined Patent Publication No. 10-78776 (paragraph 0013 and FIG. 1) discloses the technology that converts the pitch of a voice as material (hereafter referred to as a "source voice") to generate a concord sound (voices constituting a chord with the source voice) and adds the concord sound to the source voice for output. Even though one utterer vocalizes the source voice, the technology according to this configuration can output voices audible as if multiple persons sang individual melodies in chorus. When the source voice represents a musical instrument's sound, the technology generates voices audible as if multiple musical instruments were played in concert.

Types of chorus and ensemble include: a general chorus in which multiple performers sing or play individual melodies; and a unison in which multiple performers sing or play the same melody. The technology described in Japanese Non-examined Patent Publication No. 10-78776 generates a concord sound by converting the source voice pitch. Accordingly, the technology can generate a voice simulating individual melodies sung or played by multiple performers, but cannot provide the source voice with a unison effect of the common melody sung or played by multiple performers. The technology described in Japanese Non-examined Patent Publication No. 10-78776 can also output the source voice together with a voice only having the acoustic characteristic (voice quality) converted without changing the source voice pitch, for example. In this manner, somehow or other, it is possible to provide an effect of the common melody sung or played by multiple performers. In this case, however, it is required to provide a scheme to convert source voice characteristics for each of voices constituting the unison. Consequently, an attempt to provide a unison composed of many performers enlarges the circuit scale for a configuration that converts source voice characteristics using hardware such as a DSP (Digital Signal Processor). In a configuration that uses software for this conversion, the processor is subject to excessive processing loads. The present invention has been made in consideration of the foregoing.

SUMMARY OF THE INVENTION

It is therefore an object of the present invention to synthesize an output voice composed of multiple voices using a simple configuration.

To achieve this object, a voice synthesizer according to the present invention comprises: a data acquisition portion for successively obtaining phonetic entity data (e.g., lyrics data in the embodiment) specifying a phonetic entity; an envelope acquisition portion for obtaining a spectral envelope of a voice segment corresponding to an phonetic entity specified by the phonetic entity data out of a plurality of voice segments corresponding to different phonetic entities; a spectrum acquisition portion for obtaining a conversion spectrum, i.e., a collective frequency spectrum of a target voice containing a plurality of parallel generated voices; an envelope adjustment portion for adjusting a spectral envelope of the conversion spectrum obtained by the spectrum acquisition portion so as to approximately match with the spectral envelope obtained by the envelope acquisition portion; and a voice generation portion for generating an output voice signal from the conversion spectrum adjusted by the envelope adjustment portion. The term "voice" in the present invention includes various sounds such as a human voice and a musical instrument sound.

According to this configuration, the collective spectral envelope of the conversion voice containing multiple parallel vocalized voices is adjusted so as to approximately match with the spectral envelope of a source voice collected as a voice segment. Accordingly, it is possible to generate an output voice signal of multiple voices (i.e., choir sound or ensemble sound) having the voice segment's phonetic entity. In principle, there is no need to provide an independent element for converting a voice segment property with respect to each of multiple voices to be contained in the output voice indicated by the output voice signal. The configuration of the inventive voice synthesizer is greatly simplified in comparison with the configuration described in Japanese Non-examined Patent Publication No. 10-78776. In other words, it is possible to synthesize an output voice composed of so many voices without complexing the configuration of the voice synthesizer.

The term "voice segment" in the present invention represents the concept including both a phoneme and a phoneme concatenation composed of multiple concatenated phonemes. The phoneme is an audibly distinguishable minimum unit of voice (typically the human voice). The phoneme is classified into a consonant (e.g., "s") and a vowel (e.g., "a"). The phoneme concatenation is an alternate concatenation of multiple phonemes corresponding to vowels or consonants along the time axis such as a combination of a consonant and a succeeding vowel (e.g., [s_a]), a combination of a vowel and a succeeding consonant (e.g., [i_t]), and a combination of a vowel and a succeeding vowel (e.g., [a_i]). The voice segment can be provided in any mode. For example, the voice segment may be presented as waveforms in a time domain (time axis) or spectra in a frequency domain (frequency axis).

When a sound is actually generated based on an output voice signal generated from the frequency spectrum adjusted by the envelope adjustment portion, the voice's phonetic entity may approximate (ideally match) the voice segment's phonetic entity in such a degree that they can be sensed audibly the same. In this case, the voice segment's spectral envelope is assumed to "approximately match" the conversion spectrum's spectral envelope. Therefore, it is not always necessary to ensure strict correspondence between the voice segment's spectral envelope and the spectral envelope of the conversion voice adjusted by the envelope adjustment portion.

On the voice synthesizer according to the present invention, an output voice signal generated from the voice generation portion is supplied to a sound generation device such as a speaker or an earphone and is output as an output voice. This output voice signal can be used in any mode. For example, the output voice signal may be stored on a recording medium. Another apparatus for reproducing the stored signal may be used to output an output voice. Further, the output voice signal may be transmitted to another apparatus via a communication line. That apparatus may reproduce the output voice signal as a voice.

On the voice synthesizer according to the present invention, the envelope acquisition portion may use any method to obtain the voice segment's spectral envelope. For example, there may be a configuration provided with a storage portion for storing a spectral envelope corresponding to each of multiple voice segments. In this configuration, the envelope acquisition portion reads, from the storage portion, a spectral envelope of the voice segment corresponding to the phonetic entity specified by the phonetic entity data (first embodiment). This configuration provides an advantage of simplifying a process of obtaining the voice segment's spectral envelope. There may be another configuration provided with a storage portion for storing a frequency spectrum corresponding to each of multiple voice segments. In this configuration, the envelope acquisition portion reads, from the storage portion, a frequency spectrum of the voice segment corresponding to the phonetic entity specified by the phonetic entity data and extracts a spectral envelope from this frequency spectrum (see FIG. 10). This configuration provides an advantage of being able to use a frequency spectrum stored in the storage portion also for generation of an output voice composed of a single voice. There may be still another configuration where the storage portion stores a signal (source voice signal) indicative of the voice segment's waveform along the time axis. In this configuration, the envelope acquisition portion obtains the voice segment's spectral envelope from the source voice signal.

In the preferred embodiments of the present invention, the spectrum acquisition portion obtains a conversion spectrum of the conversion voice corresponding to the phonetic entity specified by phonetic entity data out of multiple conversion voices vocalized with different phonetic entities. In this mode, the conversion voice as a basis for output voice signal generation is selected from conversion voices with multiple phonetic entities. Consequently, natural output voices can be generated in comparison with the configuration where an output voice signal is generated from a conversion voice with a single phonetic entity.

According to another mode of the present invention, the voice synthesizer further comprises a pitch acquisition portion for obtaining pitch data (e.g., musical note data according to the embodiment) specifying a pitch; and a pitch conversion portion for varying each peak frequency contained in the conversion spectrum obtained by the spectrum acquisition portion. The envelope adjustment portion adjusts the spectral envelope of a conversion spectrum processed by the pitch conversion portion. According to this mode, an output voice signal's pitch can be appropriately specified in accordance with the pitch data. It may be preferable to use any method of changing a frequency of each peak contained in the conversion spectrum (i.e., any method of changing the conversion voice's pitch). For example, the pitch conversion portion extends or contracts the conversion spectrum along the frequency axis in accordance with the pitch specified by pitch data. This mode can adjust the conversion spectrum pitch using a simple process of multiplying each frequency of the conversion spectrum and a numeric value corresponding to an intended pitch. In still another mode, the pitch conversion portion moves each spectrum distribution region containing each peak's frequency in the conversion spectrum along the frequency axis direction in accordance with the pitch specified by the pitch data (see FIG. 12). This mode makes it possible to allow the frequency of each peak in the conversion spectrum to accurately match an intended frequency. Accordingly, it is possible to accurately adjust conversion spectrum pitches.

There may be provided any configuration for changing output voice pitches. For example, it may be preferable to provide a configuration provided with the pitch acquisition portion for obtaining pitch data specifying pitches. In this configuration, the spectrum acquisition portion may obtain the conversion spectrum of the conversion voice with a pitch approximating (ideally matching) the pitch specified by the pitch data out of multiple conversion voices with different pitches (see FIG. 8). This mode can eliminate the need for the configuration of converting the conversion spectrum pitches. It may be preferable to combine the configuration of converting the conversion spectrum pitches with the configuration of selecting any of multiple conversion voices corresponding to different pitches. According to a possible configuration, the spectrum acquisition portion may obtain the conversion spectrum corresponding to a pitch approximate to the input voice pitch out of multiple conversion spectra corresponding to different pitches. The pitch conversion portion may convert the pitch of the selected conversion spectrum in accordance with the pitch data.

According to a preferred mode of the present invention, the envelope acquisition portion obtains a spectral envelope for each frame resulting from dividing a voice segment along the time axis. The envelope acquisition portion interpolates between a spectral envelope in the last frame for one voice segment and another spectral envelope in the first frame for the other voice segment following that voice segment to generate a spectral envelope of the voice corresponding to a gap between both frames. This mode can generate an output voice with any time duration.

Multiple singers or players may simultaneously (parallel) generate voices at approximately the same pitch. According to the frequency spectrum of these voices, the bandwidth (e.g., bandwidth W2 as shown in FIG. 4) corresponding to each peak in the voices may be often greater than the bandwidth (e.g., bandwidth W1 as shown in FIG. 3) corresponding to each peak in the frequency spectrum of a voice generated from a single singer or player. A so-called unison does not cause strict correspondence between voices generated by singers or players. From this viewpoint, the voice synthesizer according to the present invention is also configured to comprise: a data acquisition portion for successively obtaining phonetic entity data specifying a phonetic entity; an envelope acquisition portion for obtaining a spectral envelope of a voice segment corresponding to an phonetic entity specified by the phonetic entity data out of a plurality of voice segments corresponding to different phonetic entities; a spectrum acquisition portion for obtaining one of a first conversion spectrum, i.e., a frequency spectrum of a conversion voice and a second conversion spectrum which is a frequency spectrum of a voice having almost the same pitch as that of the conversion voice indicated by the first conversion spectrum and has a peak width greater than that of the first conversion spectrum; an envelope adjustment portion for adjusting a spectral envelope of the conversion spectrum obtained by the spectrum acquisition portion so as to approximately match a spectral envelope obtained by the envelope acquisition portion; and a voice generation portion for generating an output voice signal from the conversion spectrum adjusted by the envelope adjustment portion. An example of this configuration will be described later as a second embodiment (FIG. 7).

This configuration selects one of the first and second conversion spectra as the frequency spectrum for generating an output voice signal. It is possible to selectively generate an output voice signal having characteristics corresponding to the first conversion spectrum and an output voice signal having characteristics corresponding to the second conversion spectrum. For example, when the first conversion spectrum is selected, it is possible to generate an output voice generated from a single singer or a few of singers. When the second conversion spectrum is selected, it is possible to generate an output voice generated from multiple singers or players. While there are provided the first and second conversion spectra, there may be a configuration where the other conversion spectra are provided to be selected by the selection portion. According to a possible configuration, for example, a storage portion may store three types or more of conversion spectra with different peak bandwidths. The spectrum acquisition portion may select any of these conversion spectra for use for generation of output voice signals.

The voice synthesizer according to the present invention is implemented by not only hardware dedicated for voice synthesis such as a DSP, but also cooperation of a computer such as a personal computer with a program. The inventive program allows a computer to perform: a data acquisition process of successively obtaining phonetic entity data specifying a phonetic entity; an envelope acquisition process of obtaining a spectral envelope of a voice segment corresponding to an phonetic entity specified by the phonetic entity data out of a plurality of voice segments corresponding to different phonetic entities; a spectrum acquisition process of obtaining a conversion spectrum, i.e., a collective frequency spectrum of conversion voice containing a plurality of parallel generated voices; an envelope adjustment process of adjusting a spectral envelope of the conversion spectrum obtained by the spectrum acquisition process so as to approximately match with the spectral envelope obtained by the envelope acquisition process; and a voice generation process of generating an output voice signal from the conversion spectrum adjusted by the envelope adjustment process.

An inventive program according to another mode allows a computer to perform: a data acquisition process of successively obtaining phonetic entity data specifying a phonetic entity; an envelope acquisition process of obtaining a spectral envelope of a voice segment identified as corresponding to the phonetic entity specified by the phonetic entity data out of a plurality of voice segments corresponding to different phonetic entities; a spectrum acquisition process of obtaining one of a first conversion spectrum, i.e., a frequency spectrum of a conversion voice and a second conversion spectrum which is a frequency spectrum of a voice having almost the same pitch as that of the conversion voice indicated by the first conversion spectrum and which has a peak width larger than that of the first conversion spectrum; an envelope adjustment process of adjusting a spectral envelope of the conversion spectrum obtained by the spectrum acquisition portion so as to approximately match with the spectral envelope obtained by the envelope acquisition process; and a voice generation process of generating an output voice signal from the conversion spectrum adjusted by the envelope adjustment process. These programs are stored on a computer-readable recording medium (e.g., CD-ROM) and supplied to users for installation on computers. In addition, the programs are delivered via a network from a server apparatus for installation on computers.

Further, the present invention is also specified as a method for synthesizing voices. The method comprises the steps of: successively obtaining phonetic entity data specifying a phonetic entity; obtaining a spectral envelope of a voice segment identified as corresponding to the phonetic entity specified by the phonetic entity data out of a plurality of voice segments corresponding to different phonetic entities; obtaining a conversion spectrum, i.e., a collective frequency spectrum of conversion voice containing a plurality of parallel generated voices; adjusting a spectral envelope for a conversion spectrum obtained by the spectrum acquisition step so as to approximately match with the spectral envelope obtained by the envelope acquisition step; and generating an output voice signal from the conversion spectrum adjusted by the envelope adjustment step.

A voice synthesis method based on another aspect of the invention comprises the steps of: successively obtaining phonetic entity data specifying a phonetic entity; obtaining a spectral envelope of a voice segment corresponding to the phonetic entity specified by the phonetic entity data out of a plurality of voice segments corresponding to different phonetic entities; obtaining one of a first conversion spectrum, i.e., a frequency spectrum of a conversion voice and a second conversion spectrum which is a frequency spectrum of another conversion voice having almost the same pitch as that of the conversion voice indicated by the first conversion spectrum and which has a peak width larger than that of the first conversion spectrum; adjusting a spectral envelope of the conversion spectrum obtained at the spectrum acquisition step so as to approximately match with the spectral envelope obtained at the envelope acquisition step; and generating an output voice signal from the conversion spectrum adjusted at the envelope adjustment step.

As mentioned above, the present invention can use a simple configuration to synthesize an output voice composed of multiple voices.

DETAILED DESCRIPTION OF THE INVENTION

A: First Embodiment

Figure 1:
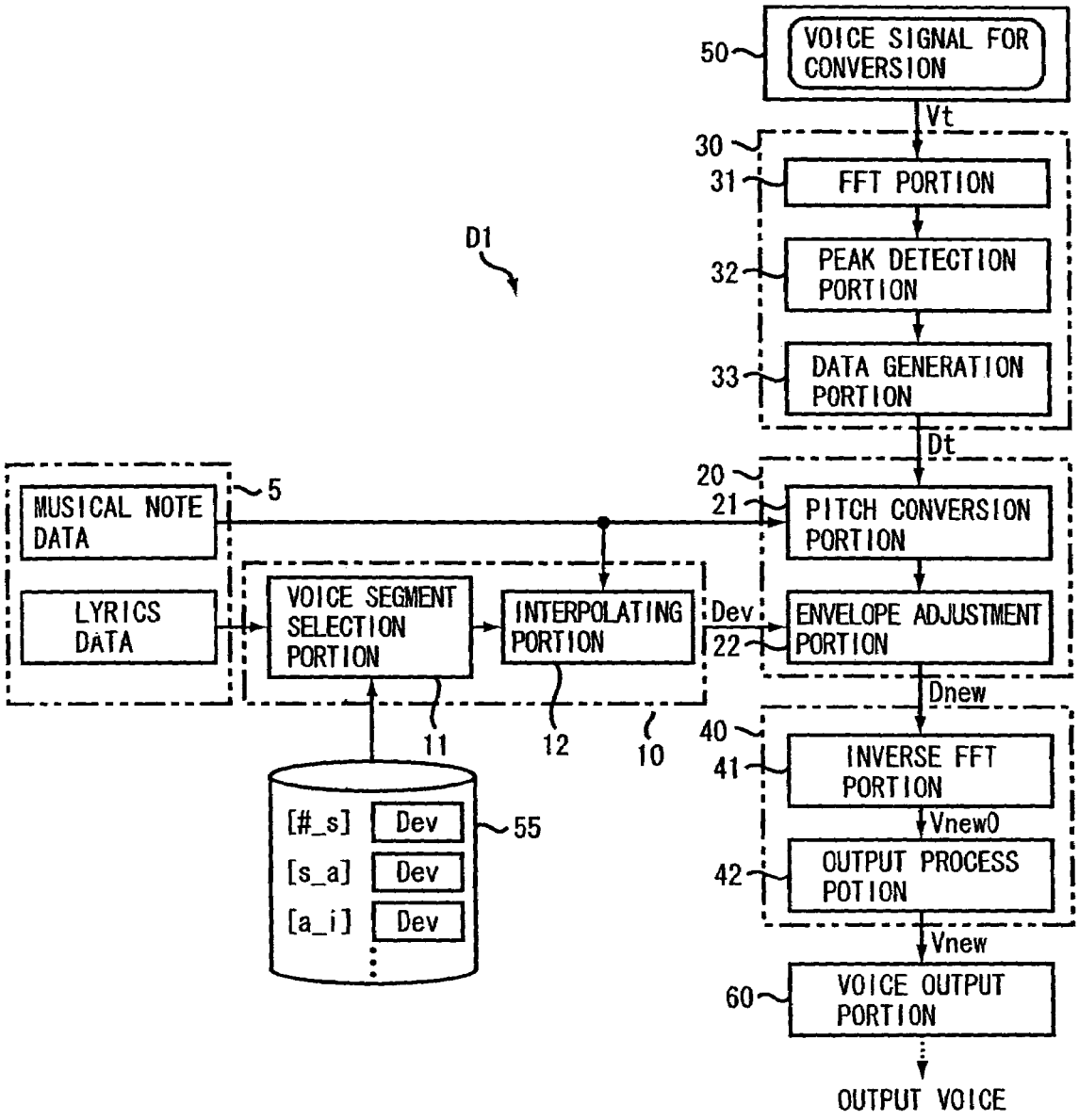
FIG. 1 is a block diagram showing the configuration of a voice synthesizer according to a first embodiment.

The following describes an embodiment that applies the present invention to an apparatus for synthesizing musical composition's singing sounds. FIG. 1 is a block diagram showing the configuration of a voice synthesizer according to the embodiment. As shown in FIG. 1, a voice synthesizer D1 has a data acquisition means 5, an envelope acquisition means 10, a spectrum conversion means 20, a spectrum acquisition means 30, a voice generation means 40, storage means 50 and 55, and a voice output portion 60. Of these, the data acquisition means 5, the envelope acquisition means 10, the spectrum conversion means 20, the spectrum acquisition means 30, and the voice generation means 40 use an arithmetic processing unit such as a CPU (Central Processing Unit). The arithmetic processing unit may be implemented by executing a program or by hardware such as a DSP dedicated for voice processing. The storage means 50 and 55 store various data. The storage means 50 and 55 represent various storage devices such as a hard disk unit containing a magnetic disk and a unit for driving removable recording media. The storage means 50 and 55 may be individual storage areas allocated in one storage device or may be provided as individual storage devices.

The data acquisition means 5 in FIG. 1 acquires data concerning musical composition performance. Specifically, the data acquisition means 5 acquires lyrics data and musical note data. The lyrics data specifies a phonetic entity (character string) of musical composition lyrics. On the other hand, the musical note data specifies: pitch P0 of each musical sound constituting a main melody (e.g., vocal part) of the musical composition; and time duration (musical note duration) T0 of the musical sound. The lyrics data and the musical note data use a data structure compliant with the MIDI (Musical Instrument Digital Interface) standard, for example. Accordingly, the data acquisition means 5 represents means for reading lyrics data and musical note data from a storage device (not shown) or a MIDI interface for receiving lyrics data and musical note data from an externally installed MIDI device.

Figure 2:
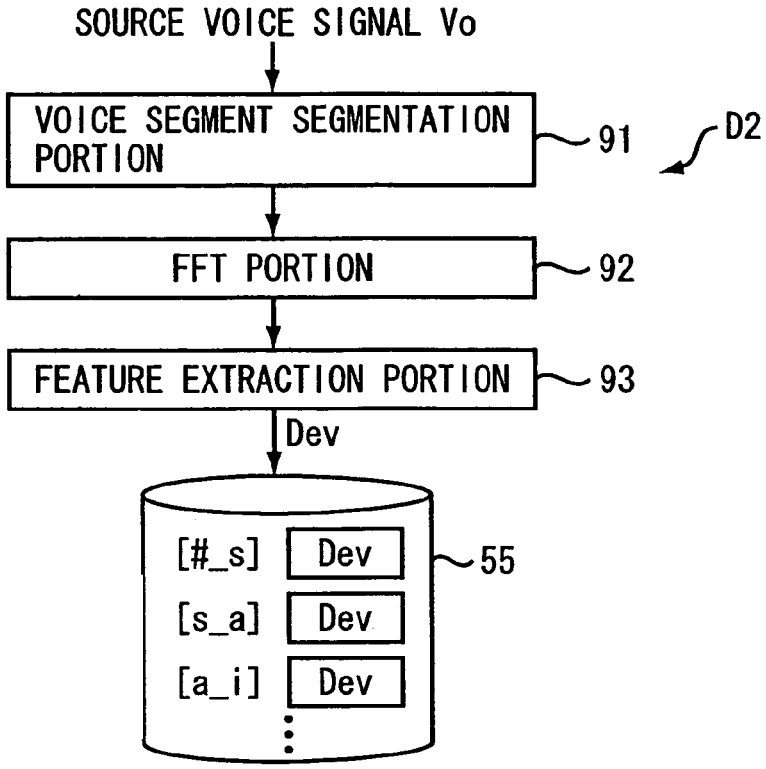
FIG. 2 is a block diagram showing the configuration and the procedure to generate envelope data.

The storage means 55 stores envelope data Dev for each voice segment. Envelope data Dev indicates a spectral envelope of a frequency spectrum of voice segment previously collected from the source voice or reference voice. Such envelope data Dev is created by a data creation apparatus D2 as shown in FIG. 2, for example. The data creation apparatus D2 may be independent of or may be included in the voice synthesizer D1.

As shown in FIG. 2, the data creation apparatus D2 has a voice segment segmentation portion 91, an FFT portion 92, and a feature extraction portion 93. The voice segment segmentation portion 91 is supplied with a source voice signal V0. When a given utterer vocalizes an intended phonetic entity at an approximately constant pitch to generate a voice (hereafter referred to as a "source voice"), the source voice signal V0 represents this source voice's waveform along the time axis. The source voice signal V0 is supplied from a sound pickup device such as a microphone, for example. The voice segment segmentation portion 91 segments an interval equivalent to an intended voice segment contained in source voice signal V0. To determine the beginning and end of this interval, for example, a creator of envelope data Dev visually checks the waveform of source voice signal V0 using a monitor display and appropriately operates control devices to designate both ends of the interval.

Figure 3:
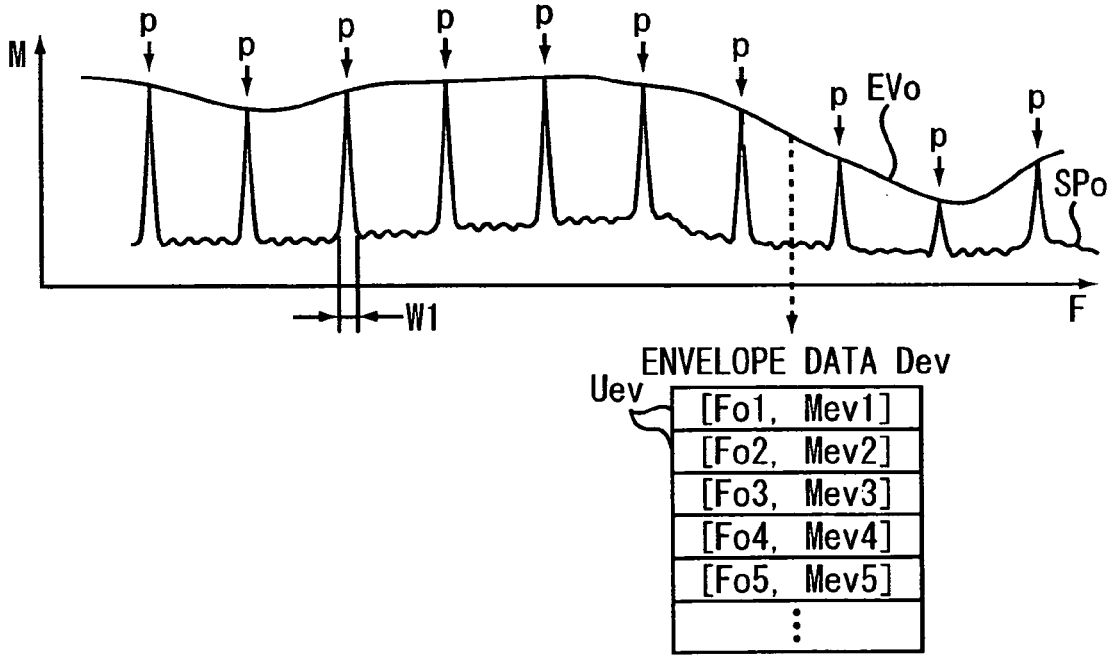
FIG. 3 is a diagram showing the process concerning a source voice signal.

The FFT portion 92 selects voice segments segmented from source voice signal V0 to form frames of specified time durations (e.g., 5 to 10 ms). The FFT portion 92 performs frequency analysis including the FFT process for source voice signal V0 on a frame basis to detect frequency spectrum SP0. Each frame of source voice signal V0 is selected so as to overlap with each other along the time axis. The embodiment assumes a voice vocalized from one utterer to be the source voice. As shown in FIG. 3, such source voice's frequency spectrum SP0 appears at bandwidth W1 whose spectrum intensity M has a very sharp local peak of respective frequencies equivalent to fundamentals and harmonics.

The feature extraction portion 93 in FIG. 2 provides means for extracting the feature quantity of source voice signal V0. The feature extraction portion 93 according to the embodiment extracts the source voice's spectral envelope EV0. As shown in FIG. 3, spectral envelope EV0 is formed by concatenating peaks p of frequency spectrum SP0. There are available methods of detecting spectral envelope EV0. For example, one is to linearly interpolate gaps between adjacent peaks p of frequency spectrum SP0 along the frequency axis, and approximate spectral envelope EV0 as a polygonal line. Another is to perform various interpolation processes such as the cubic spline interpolation and extract a curve passing through peaks p as spectral envelope EV0. The feature extraction portion 93 generates envelope data Dev indicating spectral envelope EV0 that is extracted in this manner. As shown in FIG. 3, envelope data Dev contains multiple pieces of unit data Uev. Each unit data Uev has such data structure as to combine multiple frequencies F0 (F01, F02, and so on) selected at a specified interval along the frequency axis with spectrum intensities Mev (Mev1, Mev2, and so on) of spectral envelope EV0 for the frequencies F0. The storage means 55 stores envelope data Dev created according to the above-mentioned configuration and procedure on a phonetic entity (voice segment) basis. Accordingly, the storage means 55 stores envelope data Dev corresponding to each of multiple frames on a phonetic entity basis.

The envelope acquisition means 10 in FIG. 1 acquires source voice's spectral envelope EV0 and has a voice segment selection portion 11 and an interpolating portion 12. Lyrics data acquired by the data acquisition means 5 is supplied to the voice segment selection portion 11. The voice segment selection portion 11 provides means for selecting envelope data Dev corresponding to the phonetic entity indicated by the lyrics data out of multiple pieces of envelope data Dev stored in the storage means 55 on a phonetic entity basis. For example, let us suppose that the lyrics data specifies a character string "saita". It contains voice segments [#_s], [s_a], [a_i], [i_t], [t_a], and [a_#]. Then, corresponding envelope data Dev are successively read from the storage means 55. On the other hand, the interpolating portion 12 provides means for interpolating spectral envelope EV0 of the last frame for one voice segment and spectral envelope EV0 of the top frame for the subsequent voice segment and generating spectral envelope EV0 of the voice for a gap between both frames (to be described in more detail).

The spectrum conversion means 20 in FIG. 1 provides means for generating data (hereafter referred to as "new spectrum data") Dnew indicative of output voice's frequency spectrum (hereafter referred to as "output spectrum") SPnew. The spectrum conversion means 20 according to the embodiment specifies output voice's frequency spectrum SPnew based on frequency spectrum (hereafter referred to as "conversion spectrum") SPt for a predetermined specific voice (hereafter referred to as a "conversion voice") and based on source voice's spectral envelope EV0. The procedure to generate frequency spectrum SPnew will be described later.

The spectrum acquisition means 30 provides means for acquiring conversion spectrum SPt and has an FFT portion 31, a peak detection portion 32, and a data generation portion 33. The FFT portion 31 is supplied with conversion voice signal Vt read from the storage means 50. The conversion voice signal Vt is of a time domain and represents a conversion voice waveform during a specific interval, and is stored in the storage means 50 beforehand. Similarly to the FFT portion 92 as shown in FIG. 2, the FFT portion 31 performs frequency analysis including the FFT process for conversion voice signal Vt on a frame basis to detect conversion spectrum SPt. The peak detection portion 32 detects peak pt of conversion spectrum SPt detected by the FFT portion 31 and specifies its frequency. An example method of detecting peak pt detects a peak representing the maximum spectrum intensity out of a specified number of adjacent peaks along the frequency axis.

Figure 4:
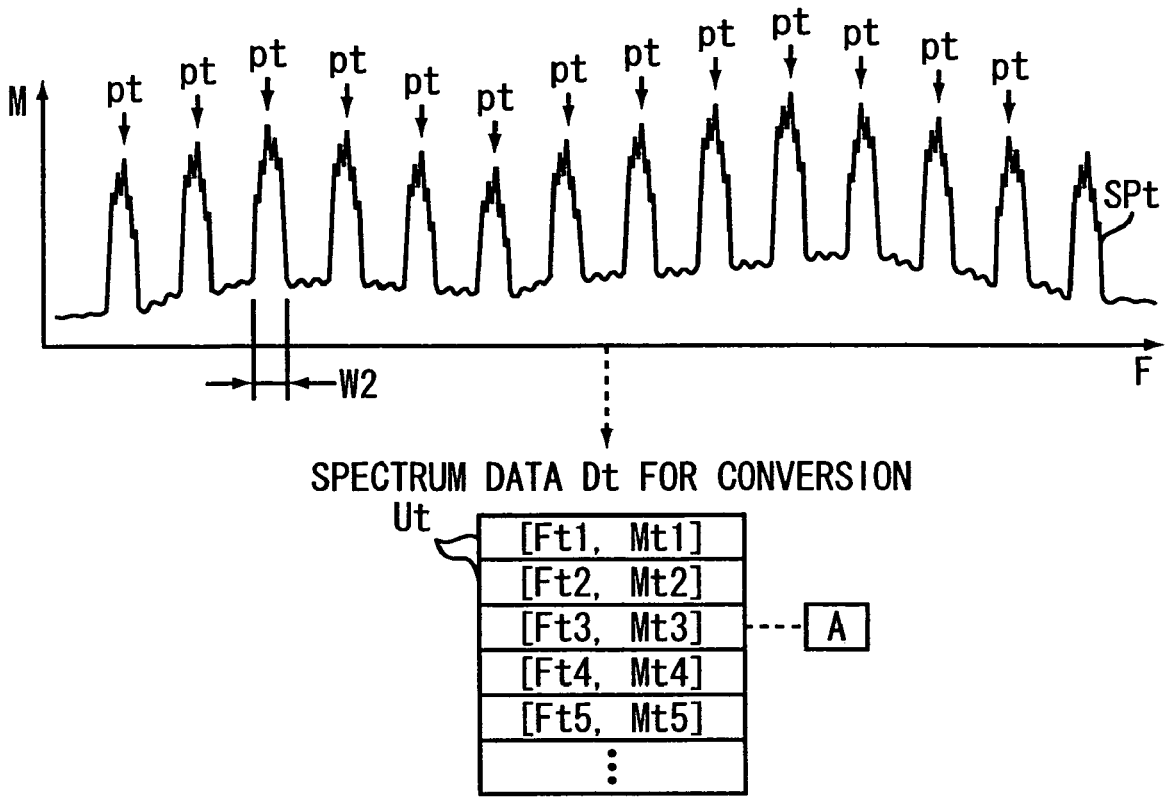
FIG. 4 is a diagram showing the process concerning a conversion voice signal.

The embodiment assumes a case where many utterers generate voices (i.e., unison voices for choir or ensemble) at approximately the same pitch Pt, a sound pickup device such as a microphone picks up the voices to generate a collective signal, and the storage means 50 stores this collective signal as conversion voice signal Vt. The FFT process is applied to such conversion voice signal Vt to produce conversion spectrum SPt. As shown in FIG. 4, conversion spectrum SPt is similar to frequency spectrum SP0 in FIG. 3 such that local peak pt representing spectrum intensity M appears in respective frequencies equivalent to fundamentals and harmonics corresponding to conversion voice pitch Pt. In addition, conversion spectrum SPt is characterized in that bandwidth W2 of each peak pt is wider than bandwidth W1 of each peak p of reference frequency spectrum SP0. Bandwidth W2 of peak pt is wide because pitches of voices generated from many utterers do not match completely.

The data generation portion 33 in FIG. 1 provides means for generating data (hereafter referred to as "conversion spectrum data") Dt representing conversion spectrum SPt. As shown in FIG. 4, conversion spectrum data Dt contains multiple pieces of unit data Ut and an indicator A. Similarly to envelope data Dev, each unit data Ut has such data structure as to combine multiple frequencies Ft (Ft1, Ft2, and so on) selected at a specified interval along the frequency axis with spectrum intensities Mt (Mt1, Mt2, and so on) of spectral conversion spectrum SPt for the frequencies Ft. On the other hand, indicator A is data (e.g., a flag) for indicating peak pt of conversion spectrum SPt. Indicator A is selectively added to unit data Ut corresponding to peak pt detected by the peak detection portion 32 out of all unit data Ut contained in conversion spectrum data Dt. When the peak detection portion 32 detects peak pt in frequency Ft3, for example, indicator A is added to unit data Ut containing frequency Ft3 as shown in FIG. 4. Indicator A is not added to other unit data Ut (i.e., unit data Ut corresponding to frequencies other than that for peak pt).

The following describes the configuration and operations of the spectrum conversion means 20. As shown in FIG. 1, the spectrum conversion means 20 has a pitch conversion portion 21 and an envelope adjustment portion 22. The pitch conversion portion 21 is supplied with conversion spectrum data Dt output from the spectrum acquisition means 30 and musical note data obtained by the data acquisition means 5. The pitch conversion portion 21 provides means for varying pitch Pt of the conversion voice indicated by conversion spectrum data Dt according to pitch P0 indicated by the musical note data. The pitch conversion portion 21 according to the embodiment transforms conversion spectrum SPt so that pitch Pt of conversion spectrum data Dt approximately matches pitch P0 specified by the musical note data. A specific procedure for this transformation will be described with reference to FIG. 5.

Figure 5:
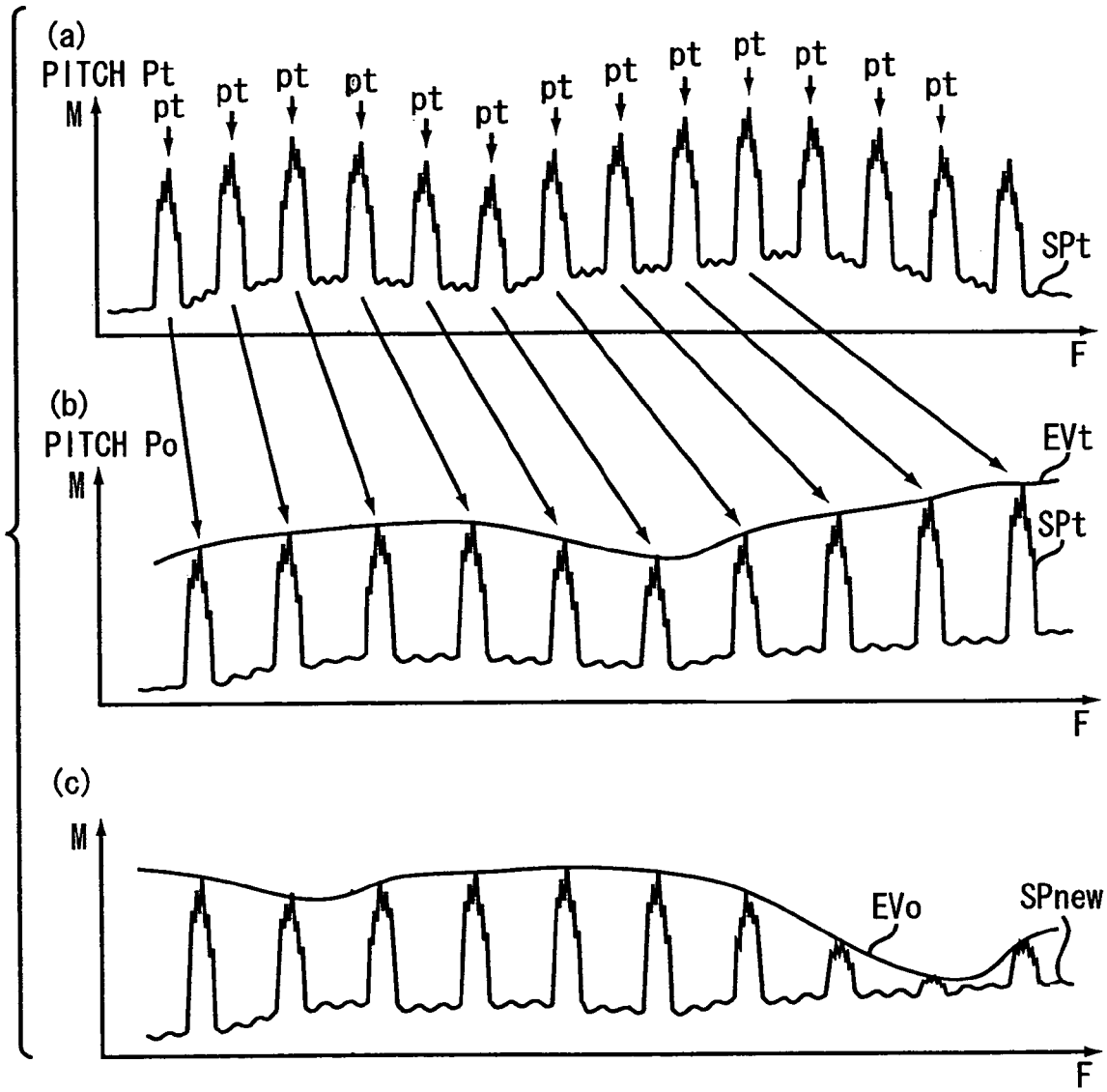
FIG. 5 is a diagram showing the process by spectrum conversion means.

FIG. 5(*a*) shows conversion spectrum SPt which is also shown in FIG. 4. The pitch conversion portion 21 enlarges or contracts conversion spectrum SPt in the direction of the frequency axis to change the frequency of each peak pt for the conversion spectrum SPt in accordance with pitch P0. In more detail, the pitch conversion portion 21 calculates "P0/Pt", i.e., a ratio of pitch P0 indicated by the musical note data to pitch Pt of the conversion voice. The pitch conversion portion 21 multiplies this ratio and frequencies Ft (Ft1, Ft2, and so on) of respective unit data Ut constituting the conversion spectrum data Dt together. The conversion voice's pitch Pt is specified as the frequency for peak pt equivalent to the fundamental (i.e., peak pt with the minimum frequency) out of many peaks pt for conversion spectrum SPt, for example. According to this process, as shown in FIG. 5(*b*), each peak pt for conversion spectrum SPt shifts to the frequency corresponding to pitch P0. As a result, pitch Pt for the conversion voice approximately matches pitch P0. The pitch conversion portion 21 outputs conversion spectrum data Dt indicative of pitch-converted conversion spectrum SPt to the envelope adjustment portion 22.

The envelope adjustment portion 22 in FIG. 1 provides means for generating new spectrum SPnew by adjusting spectrum intensity M (i.e., spectral envelope EVt) of conversion spectrum SPt indicated by conversion spectrum data Dt. In more detail, the envelope adjustment portion 22, as shown in FIG. 5(*c*), adjusts spectrum intensity M of conversion spectrum SPt, such that the spectral envelope of new spectrum SPnew approximately matches with spectral envelope EV0 obtained by the envelope acquisition means 10. The following describes an example method of adjusting spectrum intensity M.

The envelope adjustment portion 22 first selects one piece of unit data Ut provided with the indicator A out of conversion spectrum data Dt. This unit data Ut contains frequency Ft and spectrum intensity Mt of any peak pt (hereafter specifically referred to as "focused peak pt") for conversion spectrum SPt (see FIG. 4). The envelope adjustment portion 22 then selects unit data Uev containing frequency F0 approximating or matching frequency Ft with focused peak pt out of envelope data Dev supplied from the envelope acquisition means 10. The envelope adjustment portion 22 calculates "Mev/Mt", i.e., a ratio of spectrum intensity Mev contained in the selected unit data Uev to spectrum intensity Mt for focused peak pt. The envelope adjustment portion 22 then multiplies this ratio and spectrum intensity Mt of each unit data Ut for conversion spectrum SPt belonging to a specified band around focused peak pt together. This sequence of processes is repeated for all peaks pt for conversion spectrum SPt. Consequently, as shown in FIG. 5(*c*), new spectrum SPnew is so shaped that each peak's vertex is positioned on spectral envelope EV0. The envelope adjustment portion 22 outputs new spectral data Dnew indicative of this new spectrum SPnew.

The pitch conversion portion 21 and the envelope adjustment portion 22 perform the processes for each frame resulting from dividing source voice signal V0 and conversion voice signal Vt. The total number of frames for the conversion voice is limited in accordance with the time duration of conversion voice signal Vt stored in the storage means 50. By contrast, time duration T0 indicated by the musical note data varies with musical composition contents. In many cases, the total number of frames for the conversion voice differs from time duration T0 indicated by the musical note data. When the total number of frames for the conversion voice is smaller than time duration T0, the spectrum acquisition means 30 uses frames of conversion voice signal Vt in a loop fashion. That is, the spectrum acquisition means 30 completely outputs conversion spectrum data Dt corresponding to all frames to the spectrum conversion means 20. The spectrum acquisition means 30 then outputs conversion spectrum data Dt corresponding to the first frame for conversion voice signal Vt to the conversion means 20. When the total number of frames for the conversion voice signal Vt is greater than time duration T0, it just needs to discard conversion spectrum data Dt corresponding to extra frames.

The source voice may be also subject to such mismatch of the number of frames. That is, the total number of frames for the source voice (i.e., the total number of envelope data Dev corresponding to one phonetic entity) becomes the same as a fixed value selected at the time of creating spectral envelope EV0. By contrast, time duration T0 indicated by the musical note data varies with musical composition contents. The total number of frames for the source voice corresponding to one phonetic entity may be insufficient for time duration T0 indicated by the musical note data. To solve this problem, the embodiment finds a time duration corresponding to the total number of frames for one voice segment and the total number of frames for the subsequent voice segment. When the time duration is shorter than time duration T0 indicated by the musical note data, the embodiment generates a voice for the gap between both voice segments by interpolation. The interpolating portion 12 in FIG. 1 performs this interpolation.

Figure 6:
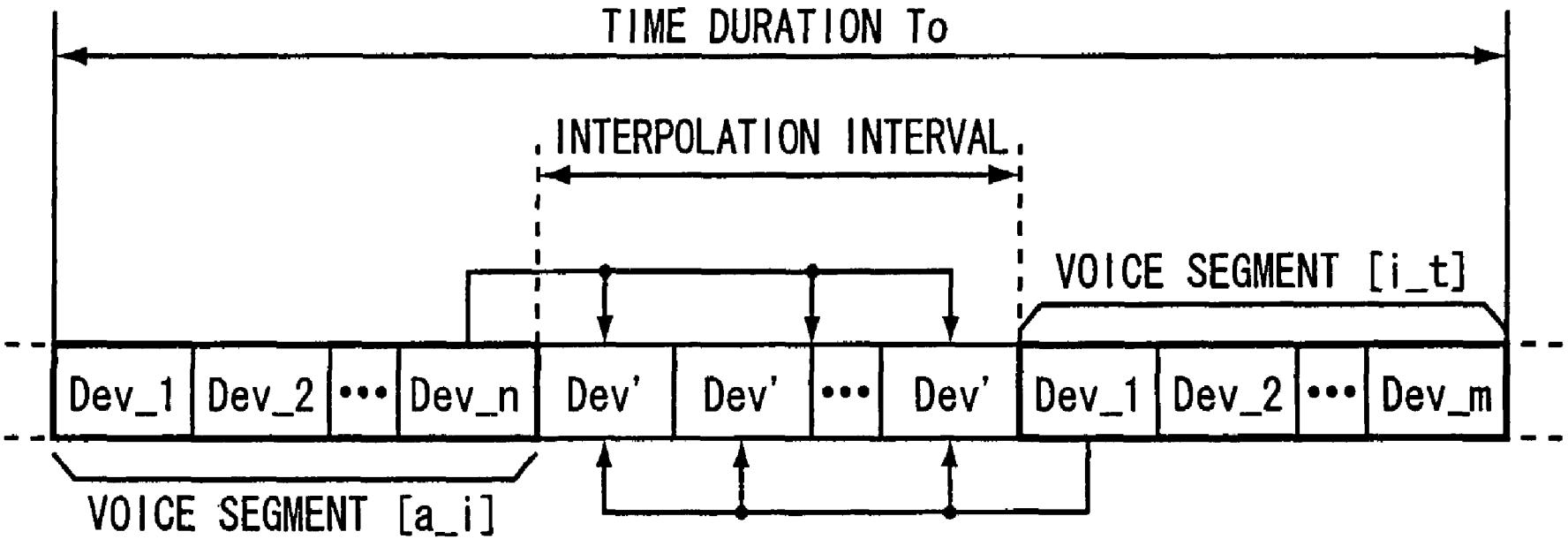
FIG. 6 is a diagram showing an interpolation process for envelope data.

As shown in FIG. 6, for example, let us suppose a case of concatenating voice segment [a_i] with voice segment [i_t]. The time duration equivalent to the sum of the total number of frames for voice segment [a_i] and the total number of frames for voice segment [i_t] may be shorter than time duration T0 indicated by the musical note data. As shown in FIG. 6, the interpolating portion 12 performs an interpolation process based on envelope data Dev_n corresponding to the last frame for voice segment [a_i] and envelope data Dev_1 corresponding to the first frame for voice segment [i_t]. In this manner, the interpolating portion 12 generates envelope data Dev' indicative of a spectral envelope for a voice inserted into a gap between these frames. The number of envelope data Dev' is specified so that the length from the beginning of voice segment [a_i] to the end of voice segment [i_t] approximately equals time duration T0. The interpolation process generates envelope data Dev' indicating spectral envelopes. The spectral envelopes are shaped so that spectral envelope EV0 indicated by the last envelope data Dev_n for voice segment [a_i] is smoothly concatenated with spectral envelope EV0 indicated by the first envelope data Dev_1 for voice segment [i_t]. The interpolating portion 12 interpolates envelope data Dev (containing interpolated envelope data Dev') and outputs it to the envelope adjustment portion 22 of the spectrum conversion means 20.

The voice generation means 40 as shown in FIG. 1 works based on new spectrum SPnew to generate output voice signal Vnew for the time domain and has an inverse FFT portion 41 and an output process portion 42. The inverse FFT portion 41 applies an inverse FFT process to new spectral data Dnew output for each frame from the envelope adjustment portion 22 to generate output voice signal Vnew0 for the time domain. The output process portion 42 multiplies a time window function and the generated output voice signal Vnew0 for each frame together. The output process portion 42 concatenates these signals so as to be overlapped with each other on the time axis to generate output voice signal Vnew. The output voice signal Vnew is supplied to the voice output portion 60. The voice output portion 60 has: a D/A converter that converts output voice signal Vnew into an analog electric signal; and a sound generation device (e.g., speaker and headphone) that generates sound based on an output signal from the D/A converter.

According to the embodiment, as mentioned above, the conversion voice contains multiple voices generated from many utterers and is adjusted so that spectral envelope EVt for the conversion voice approximately matches spectral envelope EV0 for the source voice. It is possible to generate output voice signal Vnew indicative of multiple voices (i.e., choir sound and ensemble sound) having the phonetic entity similar to the source voice. Even when the source voice represents a voice generated from one singer or player, the voice output portion 60 can output a voice sounded as if many singers or players sang in chorus or played in concert. In principle, there is no need for an independent element that generates each of multiple voices contained in the output voice. The configuration of the voice synthesizer D1 is greatly simplified in comparison with the configuration described in patent document 1. Further, the embodiment converts pitch Pt of conversion spectrum SPt in accordance with musical note data, making it possible to generate choir sounds and ensemble sounds at any pitch. There is another advantage of implementing the pitch conversion using the simple process (multiplication process) by extending conversion spectrum SPt in the direction of the frequency axis.

B: Second Embodiment

The following describes a voice synthesizer according to the second embodiment of the present invention. The mutually corresponding parts in the first and second embodiments are designated by the same reference numerals and a detailed description is appropriately omitted for simplicity.

Figure 7:
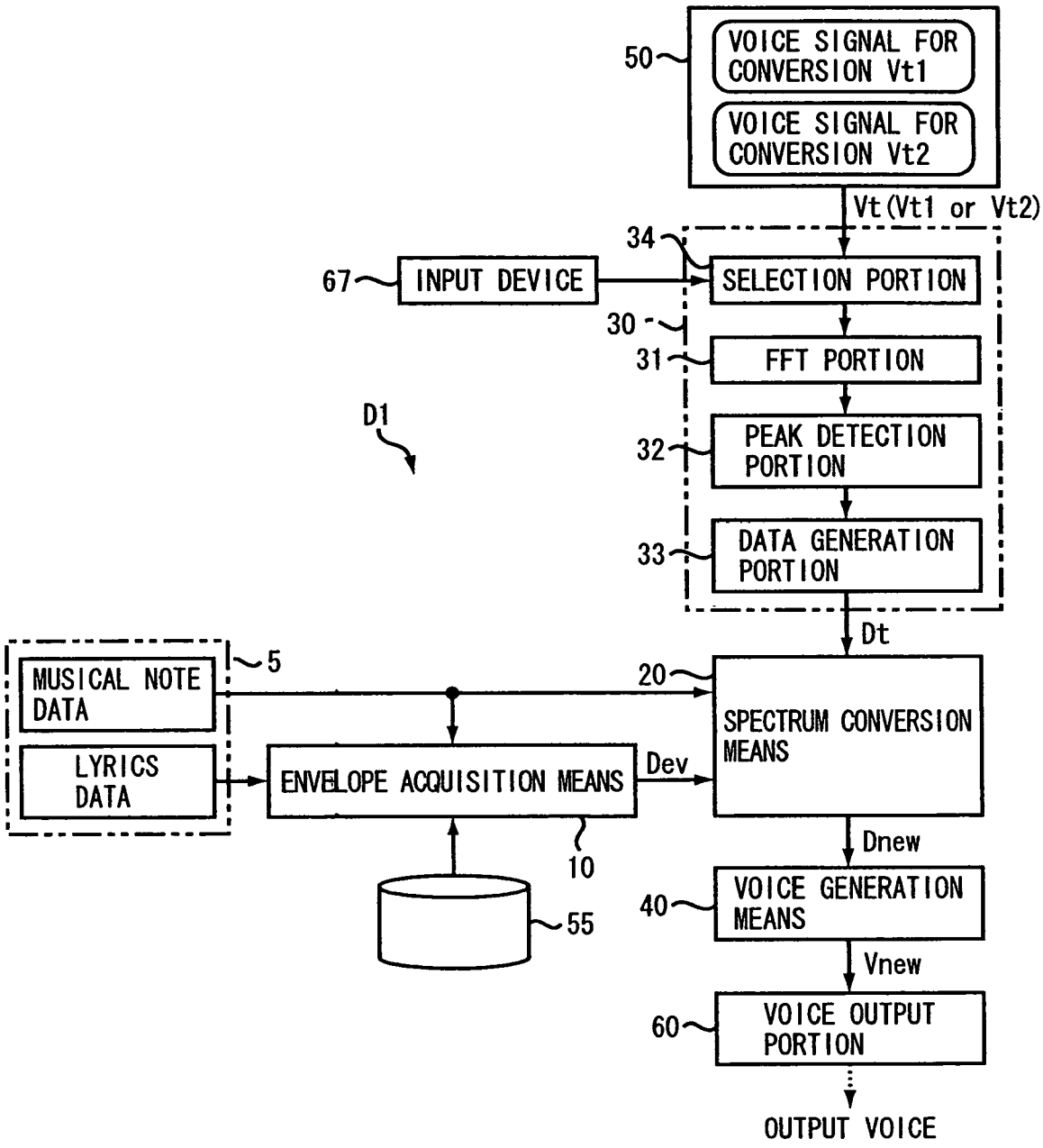
FIG. 7 is a block diagram showing the configuration of a voice synthesizer according to a second embodiment.

FIG. 7 is a block diagram showing the configuration of the voice synthesizer D1 according to the embodiment. As shown in FIG. 7, the voice synthesizer D1 has the same configuration as the voice synthesizer D1 according to the first embodiment except contents stored in the storage means 50 and the configuration of the spectrum acquisition means 30. According to the embodiment, the storage means 50 stores first conversion voice signal Vt1 and second conversion voice signal Vt2. The first conversion voice signal Vt1 and the second conversion voice signal Vt2 are picked up from conversion voices generated at approximately the same pitch Pt. The first conversion voice signal Vt1 is similar to the source voice V0 as shown in FIG. 2 and indicates the waveform of a single voice (voice from one utterer or played sound from one musical instrument) or relatively small number of voices. The second conversion voice signal Vt2 is similar to conversion voice Vt according to the first embodiment and is picked up from a conversion voice composed of multiple parallel generated voices (voices from relatively many utterers or played sounds from many musical instruments). The second conversion voice signal Vt2 specifies conversion spectrum SPt that contains a bandwidth (bandwidth W2 in FIG. 4) at respective peaks. The first conversion voice signal Vt1 specifies conversion spectrum SPt that contains a bandwidth (bandwidth W1 in FIG. 3) at respective peaks. Accordingly, bandwidth W2 is wider than bandwidth W1.

The spectrum acquisition means 30 contains a selection portion 34 prior to the FFT portion 31. The selection portion 34 works based on an externally supplied selection signal and provides means for selecting one of the first conversion voice signal Vt1 and the second conversion voice signal Vt2 and reading it from the storage means 50. The selection signal is supplied in accordance with operations on an input device 67, for example. The selection portion 34 reads conversion voice signal Vt and supplies it to the FFT portion 31. The subsequent configuration and operations are the same as those for the first embodiment.

In this manner, the embodiment selectively uses the first conversion voice signal Vt1 and the second conversion voice signal Vt2 to generate new spectrum SPnew. Selecting the first conversion voice signal Vt1 outputs a single output voice that has both the source voice's phonetic entity and the conversion voice's frequency characteristic. On the other hand, selecting the second conversion voice signal Vt2 outputs an output voice composed of many voices maintaining the source voice's phonetic entity similarly to the first embodiment. According to the embodiment, a user can choose between a single voice and multiple voices as an output voice at discretion.

While the embodiment has described the configuration where conversion voice signal Vt is selected in accordance with operations on the input device 67, it may be preferable to use any factor as a criterion for the selection. For example, a timer interrupt may be generated at a specified interval and trigger a change from the first conversion voice signal Vt1 to the second conversion voice signal Vt2, and vice versa. When the voice synthesizer D1 according to the embodiment is applied to a chorus synthesizer, it may be preferable to employ a configuration of changing the first conversion voice signal Vt1 to the second conversion voice signal Vt2, and vice versa, in synchronization with the progress of a played musical composition. While the embodiment has described the configuration where the storage means 50 stores the first conversion voice signal Vt1 indicative of a single voice and the second conversion voice signal Vt2 indicative of multiple voices, the present invention is not limited to the number of voices indicated by each conversion voice signal Vt. For example, the first conversion voice signal Vt1 may indicate a conversion voice composed of a specified number of parallel generated voices. The second conversion voice signal Vt2 may indicate a conversion voice composed of more voices.

C: Modifications

The embodiments may be variously modified. The following describes specific modifications. These modifications may be provided in any combination.

Figure 8:
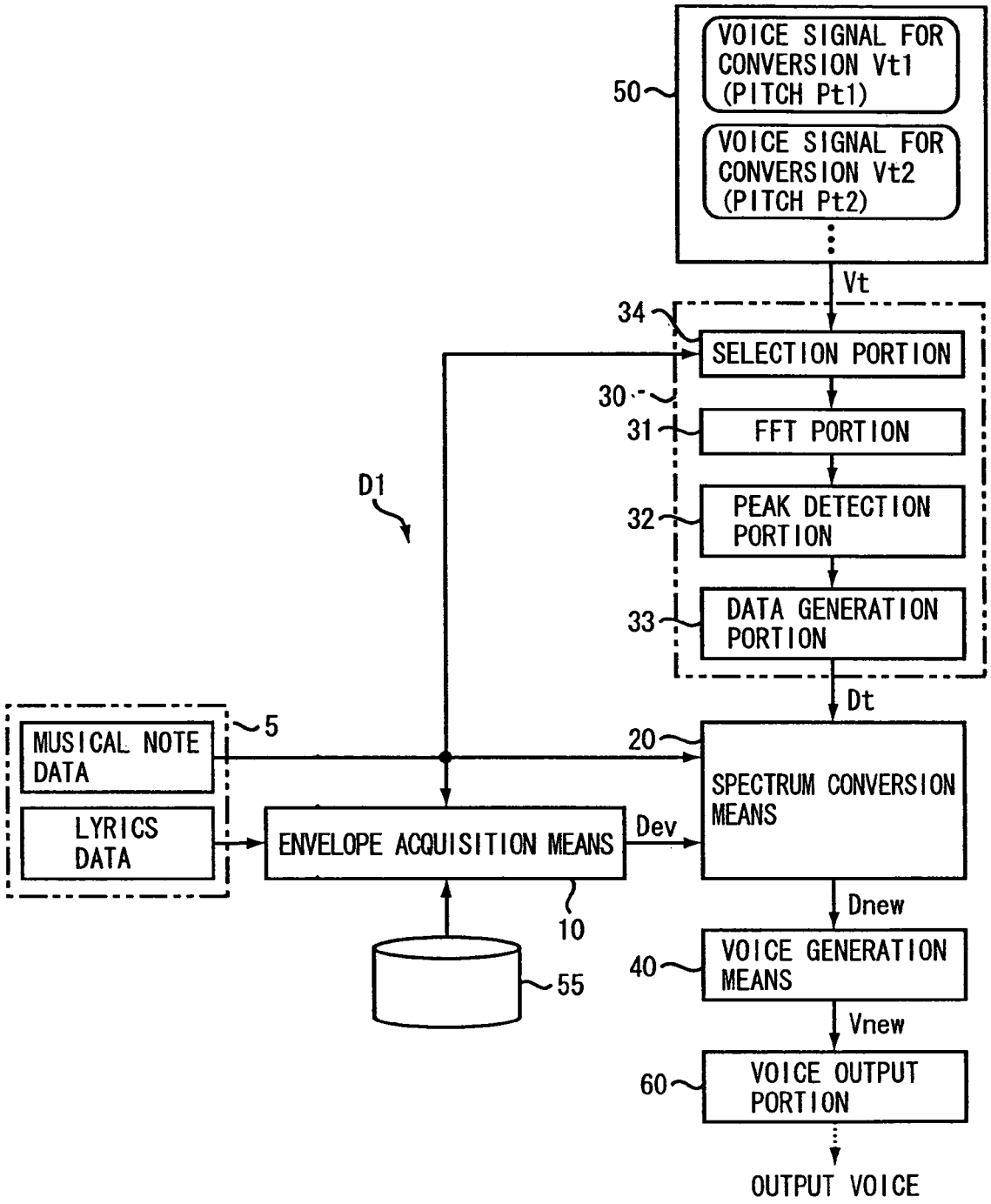
FIG. 8 is a block diagram showing the configuration of a voice synthesizer according to a modification.

(1) The above-mentioned embodiments have exemplified the configuration where the storage means 50 stores conversion voice signal Vt (Vt1 or Vt2) for one pitch Pt. As shown in FIG. 8, it may be preferable to use a configuration where the storage means 50 stores multiple conversion voice signals Vt with different pitches Pt (Pt1, Pt2, and so on). Each conversion voice signal Vt picks up a conversion voice containing many parallel generated voices. According to the configuration in FIG. 8, musical note data obtained by the data acquisition means 5 is also supplied to the control portion 34 in the spectrum acquisition means 30. The control portion 34 selects conversion voice signal Vt at pitch Pt approximating or matching pitch P0 specified by the musical note data, and reads that signal from the storage means 50. This configuration allows pitch Pt of conversion voice signal Vt used for generation of new spectrum SPnew to approximate to pitch P0 indicated by the musical note data. The pitch conversion portion 21 can perform a process to decrease the amount of changing frequencies of peaks pt in conversion spectrum SPt. Therefore, there is provided an advantage of generating naturally shaped new spectrum SPnew. According to the configuration, conversion voice signal Vt is selected and the pitch conversion portion 21 performs the process. When the storage means 50 stores conversion voice signal Vt with many pitches Pt, only selecting conversion voice signal Vt can generate an output voice having an intended pitch. The pitch conversion portion 21 is not always needed.

Figure 9:
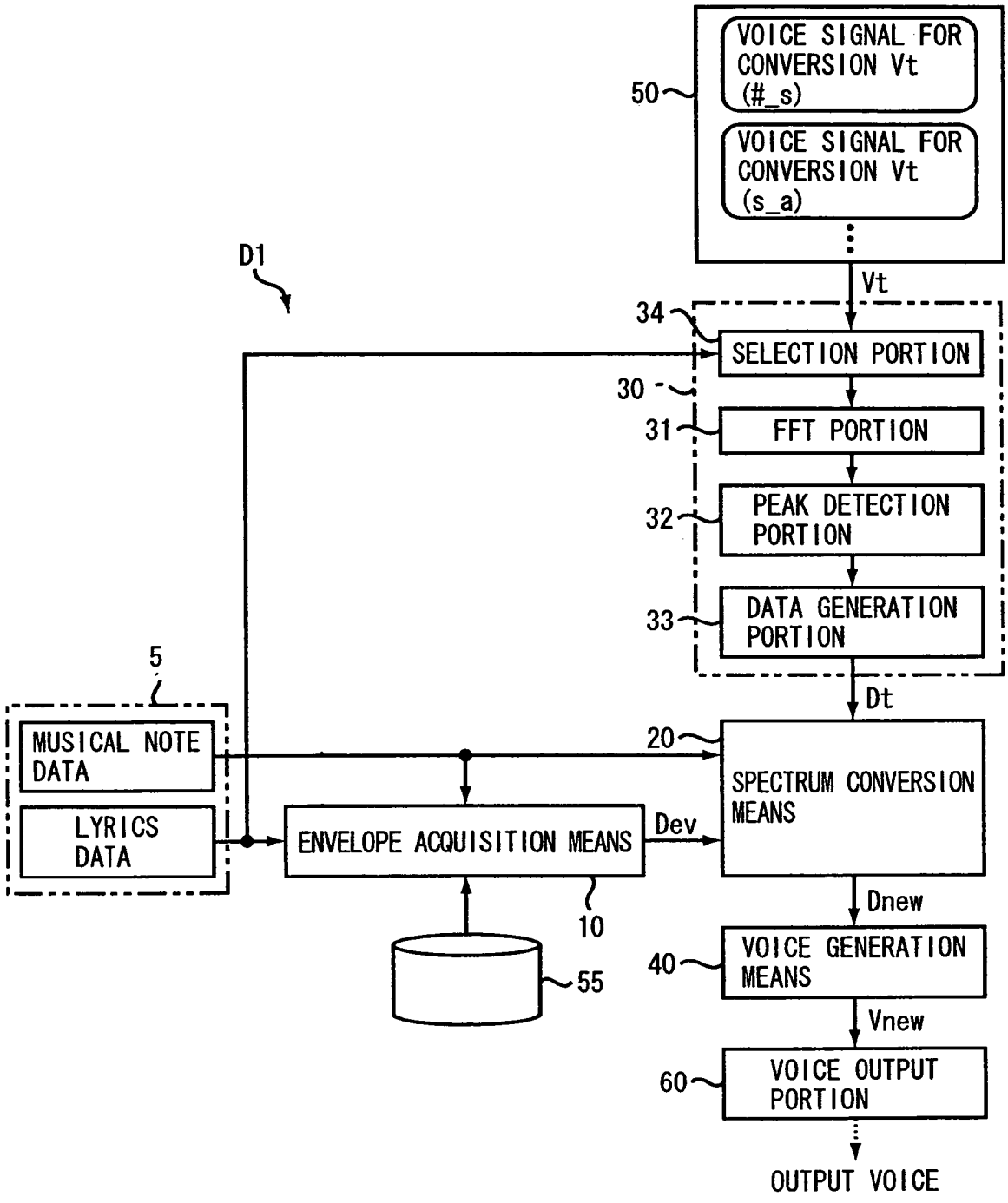
FIG. 9 is a block diagram showing the configuration of a voice synthesizer according to a modification.

(2) The above-mentioned embodiments have exemplified the configuration where the storage means 50 stores conversion voice signal Vt indicative of the conversion voice containing one phonetic entity at one moment. As shown in FIG. 9, it may be preferable to use a configuration where the storage means 50 stores conversion voice signal Vt for each of multiple conversion voices of different phonetic entities. FIG. 9 shows conversion voice signal Vt for a conversion voice vocalized with the phonetic entity of voice segment [#_s] and conversion voice signal Vt for a conversion voice vocalized with the phonetic entity of voice segment [s_a]. According to the configuration in FIG. 9, lyrics data obtained by the data acquisition means 5 is also supplied to the control portion 34 in the spectrum acquisition means 30. The control portion 34 selects conversion voice signal Vt for the phonetic entity specified by the lyrics data out of multiple conversion voice signals Vt and reads the selected signal from the storage means 50. This configuration allows spectral envelope EVt for conversion spectrum SPt to approximate to spectral envelope EV0 obtained by the envelope acquisition means 10. The envelope adjustment portion 22 decreases the amount of changing spectrum intensity M of conversion spectrum SPt. Therefore, there is provided an advantage of generating naturally shaped new spectrum SPnew with decreased spectrum shape distortion.

Figure 10:
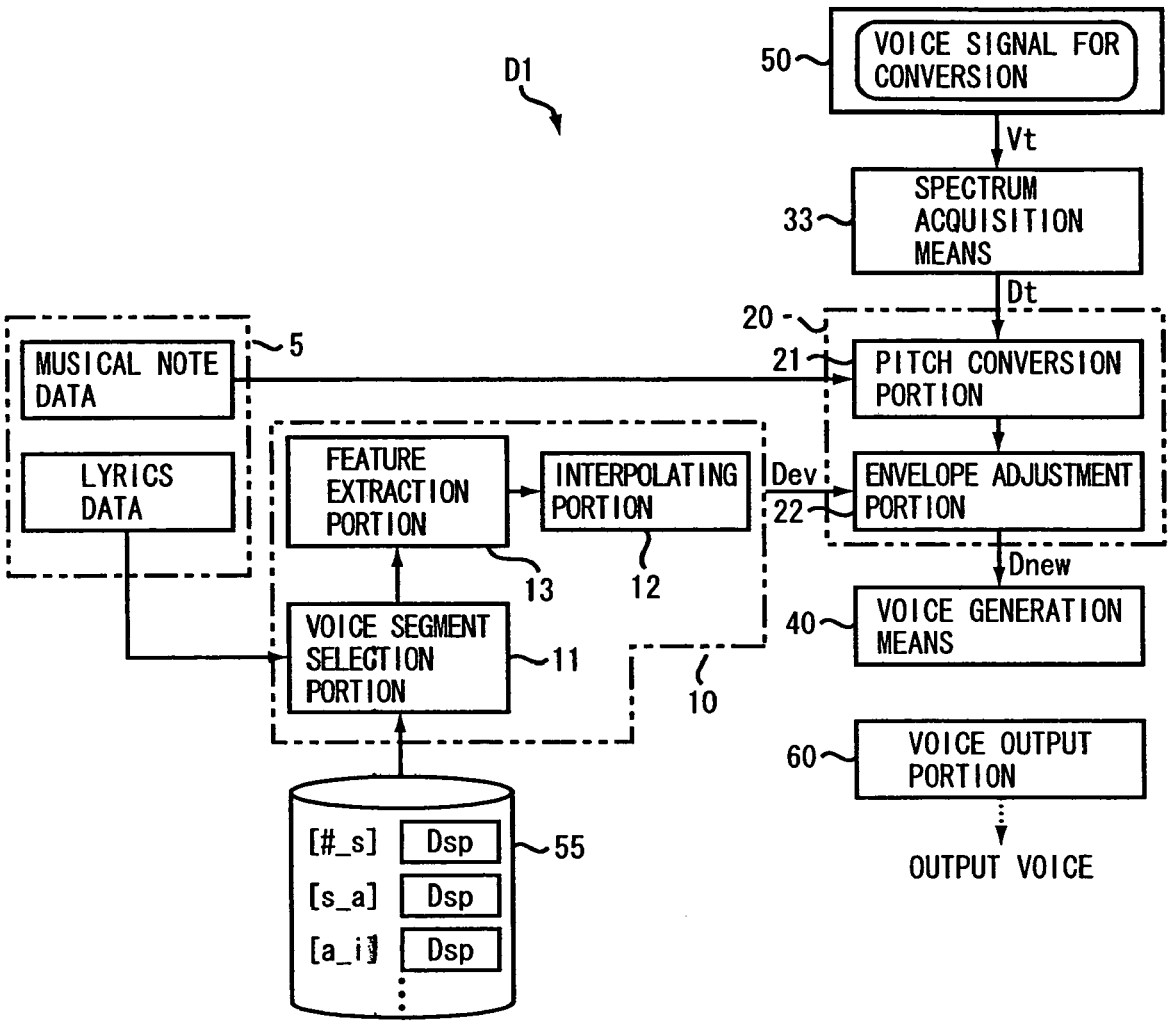
FIG. 10 is a block diagram showing the configuration of a voice synthesizer according to a modification.

(3) The above-mentioned embodiments have exemplified the configuration where the storage means 55 stores envelope data Dev indicative of the source voice's spectral envelope EV0. It may be preferable to use a configuration where the storage means 55 stores other data. As shown in FIG. 10, for example, it may be preferable to use a configuration where the storage means 55 stores data Dsp indicative of source voice's frequency spectrum SP0 (see FIG. 3) on a phonetic entity basis. This data Dsp contains multiple pieces of unit data similarly to envelope data Dev and conversion spectrum data Dt in the above-mentioned embodiments. Each unit data is a combination of multiple frequencies F selected at a specified interval along the frequency axis and spectrum intensity M of frequency spectrum SP0 for the frequencies F. Of these data Dsp, the voice segment selection portion 11 identifies and reads data Dsp corresponding to the phonetic entity indicated by lyrics data. The acquisition means 10 according to the modification contains the feature extraction portion 13 inserted between the voice segment selection portion 11 and the interpolating portion 12. The feature extraction portion 13 has the function similar to that of the feature extraction portion 93. That is, the feature extraction portion 13 specifies spectral envelope EV0 for frequency spectrum SP0 from data Dsp read by the voice segment selection portion 11. The feature extraction portion 13 outputs envelope data Dev representing spectral envelope EV0 to the interpolating portion 12. This configuration also provides an effect similar to that provided by the above-mentioned embodiments.

It may be preferable to use a configuration where the storage means 55 stores source voice signal V0 itself on a phonetic entity basis. According to this configuration, the feature extraction portion 13 in FIG. 10 firstly performs frequency analysis including the FFT process for source voice signal V0 selected by the voice segment selection portion 11 to calculate frequency spectrum SP0. The feature extraction portion 13 secondly extracts spectral envelope EV0 from frequency spectrum SP0 and outputs envelope data Dev. This process may be performed before or parallel to generation of an output voice. As mentioned above, the envelope acquisition means 10 can use any method of acquiring the source voice's spectral envelope EV0.

Figure 11:
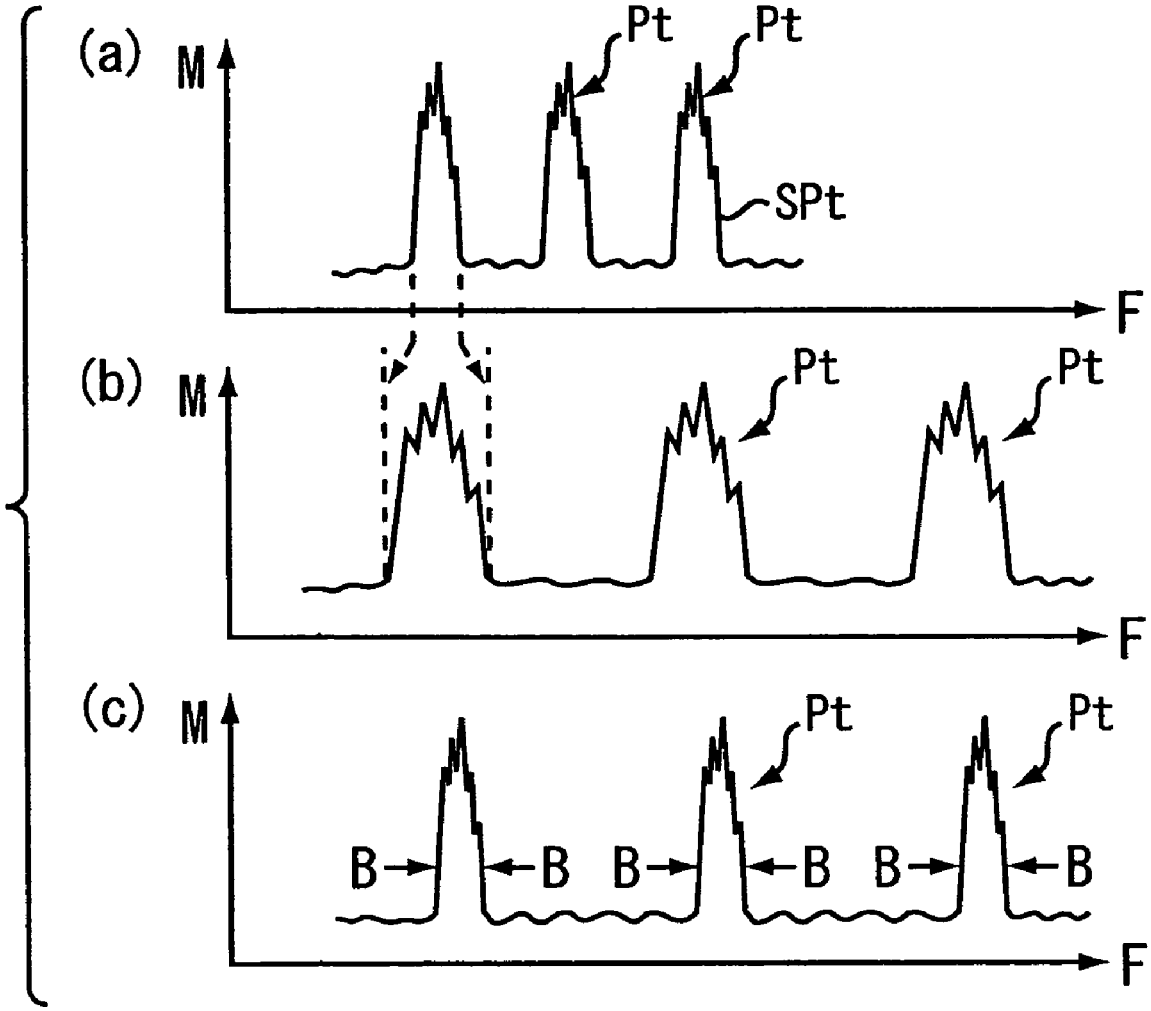
FIG. 11 is a diagram illustrating pitch conversion according to a modification.

(4) The above-mentioned embodiments have exemplified the configuration where a specific value (P0/Pt) is multiplied by frequency Ft contained in each unit data Ut of conversion spectrum data Dt to extend or reduce conversion spectrum SPt in the frequency axis direction. Further, it may be preferable to use any method of converting pitch Pt of conversion spectrum SPt. For example, the method according to the above-mentioned embodiments extends or reduces conversion spectrum SPt at the same rate over all bands. There may be a case where the bandwidth of each peak pt becomes remarkably greater than the bandwidth of the original peak pt. For example, let us suppose that the method for the first embodiment is used to convert pitch Pt of conversion spectrum SPt as shown in FIG. 11(*a*) into a double pitch. In this case, as shown in FIG. 11(*b*), the bandwidth of each peak pt approximately doubles. In this manner, making a great change in the spectrum shape of each peak pt generates an output voice that remarkably differs from the conversion voice characteristic. To solve this problem, the pitch conversion portion 21 may perform a calculation process for frequency Ft of each unit data Ut. The calculation process affects each peak pt of conversion spectrum SPt (the frequency spectrum as shown in FIG. 11(*b*)) obtained by multiplying the specific value (P0/Pt). As indicated by arrow B in FIG. 11(*c*), the bandwidth of peak pt is narrowed to that of peak pt before the pitch conversion. This configuration can generate an output voice that faithfully reproduces the conversion voice characteristic.

Figure 12:
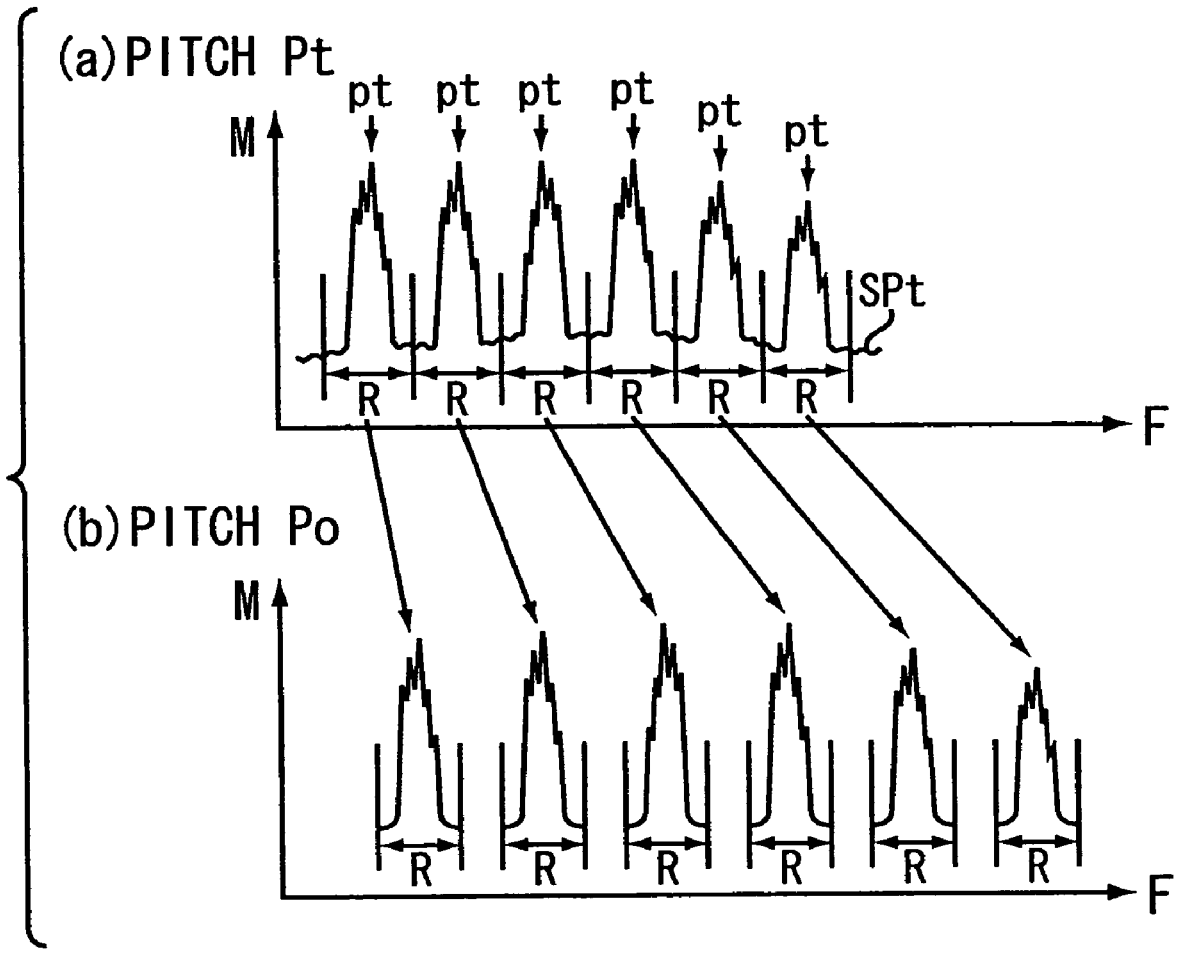
FIG. 12 is a diagram illustrating pitch conversion according to a modification.

There has been described the example of converting pitch Pt by performing the multiplication process for frequency Ft of each unit data Ut. As shown in FIG. 12(*a*), it may be also preferable to divide conversion spectrum SPt into multiple bands (hereafter referred to as "spectrum distribution regions") R along the frequency axis and move the spectrum distribution regions R along the frequency axis to change pitch Pt. Each spectrum distribution region R is selected so as to contain one peak pt and preceding and succeeding bands. As shown in FIG. 12(*b*), the pitch conversion portion 21 moves spectrum distribution regions R along the frequency axis direction so that the frequency for peak pt belonging to each spectrum distribution region R matches the frequency corresponding to pitch P0 indicated by musical note data. As shown in FIG. 12(*b*), however, there may be a band with no frequency spectrum SP0 for a gap between adjacent spectrum distribution regions R. With respect to this band, it just needs to assign a specified value (e.g., zero) to spectrum intensity M. This process can allow the frequency of each peak pt for conversion spectrum SPt to reliably match the frequency of peak pt for the source voice. There is provided an advantage of accurately generating an output voice at any pitch.

(5) The above-mentioned embodiments have exemplified the configuration where conversion spectrum SPt is specified from conversion voice Vt stored in the storage means 50. Further, it may be preferable to use a configuration where the storage means 50 previously stores conversion spectrum data Dt indicative of conversion spectrum SPt on a frame basis. According to this configuration, the spectrum acquisition means 30 just needs to read conversion spectrum data Dt from the storage means 50 and output the read data to the spectrum conversion means 20. There is no need to provide the FFT portion 31, the peak detection portion 32, or the data generation portion 33. There has been exemplified the configuration where the storage means 50 stores conversion spectrum data Dt. Further, the spectrum acquisition means 30 may acquire conversion spectrum data Dt from a communication apparatus connected via a communication line, for example. In this manner, the spectrum acquisition means 30 according to the present invention just needs to acquire conversion spectrum SPt. No special considerations are required for acquisition methods or destinations.

(6) The above-mentioned embodiments have exemplified the configuration where pitch Pt of the conversion voice matches pith P0 indicated by musical note data. Further, pitch Pt of the conversion voice may be converted into other pitches. For example, it may be preferable to use a configuration where the pitch conversion portion 21 converts pitch 0 and pitch Pt of the conversion voice so as to constitute a concord sound. This configuration can generate, as an output sound, a chorus sound constituting a main melody and the concord sound. When the pitch conversion portion 21 is provided, it just needs to be configured to change pitch Pt of a conversion voice in accordance with musical note data (i.e., in accordance with a change in pitch P0).

(7) While the above-mentioned embodiments have exemplified the case of applying the present invention to the apparatus for synthesizing sung or played sounds of musical compositions, the present invention can be applied to other apparatuses. For example, the present invention can be applied to an apparatus that works based on document data (e.g., text files) indicative of various documents and reads out character strings of the documents. That is, there may be a configuration where the voice segment selection portion 11 selects envelope data Dev of the phonetic entity corresponding to the character indicated by a character code constituting the text file, and reads the selected envelope data Dev from the storage means 50 to use this envelope data Dev for generation of new spectrum SPnew. "Phonetic entity data" according to the present invention represents the concept including all data specifying phonetic entities for output voices such as lyrics data in the above-mentioned embodiments and in this modification. When the data acquisition means 5 is configured to obtain pitch data specifying pitch P0, the configuration according to the modification can generate an output voice at any pitch. This pitch data may indicate user-specified pitch P0 or may be previously associated with document data. "Pitch data" according to the present invention represents the concept including all data specifying output voice pitches such as the musical note data in the above-mentioned embodiments and the pitch data in this modification.

The invention claimed is:

1. A voice synthesizer apparatus comprising:

a data acquisition portion that successively obtains phonetic entity data specifying a phonetic entity of a given voice;

an envelope acquisition portion that identifies a voice segment corresponding to the phonetic entity specified by the phonetic entity data out of a plurality of voice segments corresponding to different phonetic entities, and that obtains a spectral envelope of a frequency spectrum of the voice segment corresponding to the specified phonetic entity;

a spectrum acquisition portion that obtains a frequency spectrum of a plurality of voices which are generated in parallel to one another;

an envelope adjustment portion that adjusts a spectral envelope of the frequency spectrum obtained by the spectrum acquisition portion so as to match with the spectral envelope obtained by the envelope acquisition portion; and a voice generation portion that generates an output voice signal from the frequency spectrum having the spectral envelope adjusted by the envelope adjustment portion.

2. The voice synthesizer apparatus according to claim 1, further comprising:

a pitch data acquisition portion that obtains pitch data specifying a pitch of the output voice signal; and a pitch conversion portion that varies each peak frequency contained in the frequency spectrum obtained by the spectrum acquisition portion, wherein the envelope adjustment portion adjusts the spectral envelope of the frequency spectrum which is processed by the pitch conversion portion.

3. The voice synthesizer apparatus according to claim 1, wherein the spectrum acquisition portion has a microphone that collects a plurality of singing voices which are concurrently voiced by a plurality of singers, and has an extractor that extracts the frequency spectrum from the collected singing voices.

4. A voice synthesizer apparatus comprising:

a data acquisition portion that successively obtains phonetic entity data specifying a phonetic entity of a given voice;

an envelope acquisition portion that identifies a voice segment corresponding to the phonetic entity specified by the phonetic entity data out of a plurality of voice segments corresponding to different phonetic entities, and that obtains a spectral envelope of a frequency spectrum of the voice segment corresponding to the phonetic entity specified by the phonetic entity data;

a spectrum acquisition portion that obtains either of a first frequency spectrum of a single voice or a second frequency spectrum of a plurality of voices having almost the same pitch as that of the first frequency spectrum and having a peak width of frequency peaks greater than a peak width of frequency peaks contained in the first frequency spectrum;

an envelope adjustment portion that adjusts a spectral envelope of either the first frequency spectrum or the second frequency spectrum obtained by the spectrum acquisition portion so as to match with the spectral envelope obtained by the envelope acquisition portion; and a voice generation portion that generates an output voice signal from either of the first frequency spectrum or the second frequency spectrum after being adjusted by the envelope adjustment portion.

5. A voice synthesizer apparatus comprising:

an envelope acquisition portion that obtains a spectral envelope of a reference frequency spectrum of a given voice;

a spectrum acquisition portion that obtains a frequency spectrum of a plurality of voices which are generated in parallel to one another;

an envelope adjustment portion that adjusts a spectral envelope of the frequency spectrum obtained by the spectrum acquisition portion so as to match with the spectral envelope of the reference frequency spectrum obtained by the envelope acquisition portion;

and a voice generation portion that generates an output voice signal from the frequency spectrum having the spectral envelope adjusted by the envelope adjustment portion.

6. A machine-readable medium containing a program executable by a computer to perform a voice synthesizing process comprising:

a data acquisition process of successively obtaining phonetic entity data specifying a phonetic entity of a given voice;

an envelope acquisition process of identifying a voice segment corresponding to the phonetic entity specified by the phonetic entity data out of a plurality of voice segments corresponding to different phonetic entities, and obtaining a spectral envelope of a frequency spectrum of the voice segment corresponding to the specified phonetic entity;

a spectrum acquisition process of obtaining a frequency spectrum of a plurality of voices which are generated in parallel to one another;

an envelope adjustment process of adjusting a spectral envelope of the frequency spectrum obtained by the spectrum acquisition process so as to match with the spectral envelope obtained by the envelope acquisition process; and a voice generation process of generating an output voice signal from the frequency spectrum having the spectral envelope adjusted by the envelope adjustment process.

7. A machine-readable medium containing a program executable by a computer to perform a voice synthesizing process comprising:

a data acquisition process of successively obtaining phonetic entity data specifying a phonetic entity of a given voice;

an envelope acquisition process of identifying a voice segment corresponding to the phonetic entity specified by the phonetic entity data out of a plurality of voice segments corresponding to different phonetic entities, and obtaining a spectral envelope of a frequency spectrum of the voice segment corresponding to the phonetic entity specified by the phonetic entity data;

a spectrum acquisition process of obtaining either of a first frequency spectrum of a single voice or a second frequency spectrum of a plurality of voices having almost the same pitch as that of the first frequency spectrum and having a peak width of frequency peaks greater than a peak width of frequency peaks contained in the first frequency spectrum;

an envelope adjustment process of adjusting a spectral envelope of either of the first frequency spectrum or the second frequency spectrum obtained by the spectrum acquisition process so as to match with the spectral envelope obtained by the envelope acquisition process; and a voice generation process of generating an output voice signal from either of the first frequency spectrum or the second frequency spectrum after being adjusted by the envelope adjustment process.

* * * * *